US007607424B2

(12) United States Patent
Monks

(10) Patent No.: US 7,607,424 B2
(45) Date of Patent: Oct. 27, 2009

(54) ELECTRO-MAGNETICALLY OPERATED ROTATING PROJECTILE LOADER

(75) Inventor: John Steven Monks, Heywood (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 197 days.

(21) Appl. No.: 11/057,995

(22) Filed: Feb. 15, 2005

(65) Prior Publication Data

US 2006/0005825 A1 Jan. 12, 2006

Related U.S. Application Data

(60) Provisional application No. 60/545,400, filed on Feb. 17, 2004.

(51) Int. Cl.
*F41B 11/00* (2006.01)

(52) U.S. Cl. ..... 124/77

(58) Field of Classification Search ..... 124/70–77; 42/59, 84

See application file for complete search history.

(56) References Cited

U.S. PATENT DOCUMENTS

| | | | | | |
|---|---|---|---|---|---|
| 1,332,992 | A | * | 3/1920 | Moore et al. | 124/6 |
| 1,404,378 | A | * | 1/1922 | Czegka | 124/6 |
| 2,061,341 | A | * | 11/1936 | Aigner | 124/58 |
| 2,334,332 | A | * | 11/1943 | Johnson | 124/17 |
| 2,609,811 | A | * | 9/1952 | Lawrence | 124/48 |
| 2,957,391 | A | * | 10/1960 | Lovercheck | 89/28.05 |
| 3,086,469 | A | * | 4/1963 | Musgrave | 102/210 |
| 3,250,034 | A | * | 5/1966 | Simmons | 42/84 |
| 3,463,136 | A | * | 8/1969 | Joslyn et al. | 124/76 |
| 4,009,536 | A | * | 3/1977 | Wolff | 42/84 |
| 4,037,344 | A | * | 7/1977 | Reed | 42/16 |
| 4,134,223 | A | * | 1/1979 | Hillenbrandt et al. | 42/84 |
| 4,319,168 | A | | 3/1982 | Kemeny | 318/135 |
| 4,440,063 | A | * | 4/1984 | Zangrando | 89/135 |
| 4,733,595 | A | | 3/1988 | Oberly | 89/8 |
| 4,753,153 | A | | 6/1988 | Jasper, Jr. | 89/8 |
| 4,757,629 | A | * | 7/1988 | Austin | 42/84 |
| 4,819,609 | A | * | 4/1989 | Tippmann | 124/72 |
| 4,913,030 | A | | 4/1990 | Reynolds | 89/8 |
| 4,922,800 | A | | 5/1990 | Hoffman | 89/8 |
| 4,930,395 | A | | 6/1990 | Loffler | 89/8 |
| 4,944,212 | A | | 7/1990 | Hilal | 89/8 |

(Continued)

FOREIGN PATENT DOCUMENTS

| | | |
|---|---|---|
| EP | 1209435 | 5/2002 |

(Continued)

*Primary Examiner*—Troy Chambers
(74) *Attorney, Agent, or Firm*—Barlow, Josephs & Holmes, Ltd.

(57) ABSTRACT

A bolt mechanism that is actuated by an electromagnetic arrangement is provided for use within a pneumatic projectile launcher or marker. The electro-magnetic arrangement provides for rapid movement and a high degree of control over the bolt. Generally, an arrangement of electro-magnetic coils is provided that exert a force on ferrous materials or permanent magnets thereby causing the bolt to reciprocate back and forth. Several embodiments are provided that disclose configurations having varied numbers of electromagnetic coils, ferrous materials and permanent magnets strategically placed within the breech and bolt of the marker, wherein energizing the coils produces movement of the bolt. Further, the electromagnetic bolt system of the present invention is equally applicable to slide bolts as well as rotary bolts.

16 Claims, 4 Drawing Sheets

U.S. PATENT DOCUMENTS

| | | | | | |
|---|---|---|---|---|---|
| 4,986,251 | A * | 1/1991 | Lilley | 124/67 |
| 5,074,189 | A * | 12/1991 | Kurtz | 89/135 |
| 5,122,506 | A | 6/1992 | Wang | 505/1 |
| 5,127,308 | A | 7/1992 | Thompson et al. | 89/8 |
| 5,173,568 | A | 12/1992 | Parmer | 89/8 |
| 5,294,850 | A | 3/1994 | Web et al. | 310/13 |
| 5,297,468 | A | 3/1994 | Dreizin | 89/8 |
| 5,454,289 | A | 10/1995 | Bacon et al. | 89/8 |
| 5,483,863 | A | 1/1996 | Dreizin | 89/8 |
| 5,494,024 | A * | 2/1996 | Scott | 124/73 |
| 5,520,171 | A * | 5/1996 | David | 124/51.1 |
| 5,713,150 | A * | 2/1998 | Ealovega | 42/84 |
| 5,727,538 | A | 3/1998 | Ellis | 124/77 |
| 5,856,630 | A | 1/1999 | Meger | 89/8 |
| 5,947,100 | A * | 9/1999 | Anderson | 124/45 |
| 5,954,042 | A * | 9/1999 | Harvey | 124/51.1 |
| 6,062,208 | A * | 5/2000 | Seefeldt et al. | 124/71 |
| 6,142,137 | A | 11/2000 | MacLaughlin | 124/72 |
| 6,302,092 | B1 * | 10/2001 | Juan | 124/31 |
| 6,434,875 | B1 * | 8/2002 | Constant et al. | 42/84 |
| 6,439,217 | B1 | 8/2002 | Shih | 124/77 |
| 6,474,326 | B1 | 11/2002 | Smith et al. | 124/77 |
| 6,568,381 | B2 * | 5/2003 | Chang | 124/32 |
| 6,618,975 | B1 * | 9/2003 | Shih | 42/75.03 |
| 6,622,713 | B1 | 9/2003 | Thomas | 124/3 |
| 6,626,165 | B1 | 9/2003 | Bhogal | |
| 6,637,420 | B2 * | 10/2003 | Moritz | 124/73 |
| 6,688,298 | B2 * | 2/2004 | Maeda et al. | 124/48 |
| 6,725,759 | B1 | 4/2004 | Kathe et al. | 89/8 |
| 6,763,822 | B1 | 7/2004 | Styles | 124/77 |
| 6,802,305 | B1 * | 10/2004 | Hatcher | 124/31 |
| 6,901,689 | B1 * | 6/2005 | Bergstrom | 42/1.06 |
| 6,973,748 | B2 * | 12/2005 | Rice | 42/69.01 |
| 7,073,284 | B2 * | 7/2006 | Monks et al. | 42/69.01 |
| 7,076,906 | B2 * | 7/2006 | Monks et al. | 42/84 |
| 7,089,697 | B2 * | 8/2006 | Monks | 42/69.01 |
| 2002/0096164 | A1 | 7/2002 | Perrone | 124/77 |
| 2003/0000511 | A1 * | 1/2003 | Moritz | 124/73 |
| 2003/0005918 | A1 | 1/2003 | Jones | 124/70 |
| 2003/0066520 | A1 * | 4/2003 | Chang | 124/27 |
| 2003/0221684 | A1 * | 12/2003 | Rice | 124/71 |
| 2004/0200115 | A1 * | 10/2004 | Monks et al. | 42/84 |
| 2005/0188977 | A1 * | 9/2005 | Wygant | 124/73 |
| 2005/0188980 | A1 * | 9/2005 | Monks et al. | 124/77 |
| 2005/0262752 | A1 * | 12/2005 | Robinson et al. | 42/71.01 |
| 2006/0032487 | A1 * | 2/2006 | Tippmann et al. | 124/74 |
| 2007/1001749 | * | 1/2007 | Masse | 124/73 |
| 2007/0062509 | A1 * | 3/2007 | Campo et al. | 124/73 |
| 2007/0215135 | A1 * | 9/2007 | Campo | 124/77 |

FOREIGN PATENT DOCUMENTS

| | | |
|---|---|---|
| WO | WO88/05895 | 8/1988 |
| WO | WO00/75594 | 12/2000 |

* cited by examiner

ELECTRO-MAGNETICALLY OPERATED ROTATING PROJECTILE LOADER

CROSS-REFERENCE TO RELATED APPLICATIONS

This application is related to and claims priority from earlier filed U.S. Provisional Patent Application No. 60/545,400, filed Feb. 17, 2004, the contents of which are incorporated herein by reference.

BACKGROUND OF THE INVENTION

The present invention relates generally to pneumatically operated projectile launchers. More specifically, the present invention relates to an electro-magnetically operated bolt configuration for use in firearms and other projectile launchers, such as pneumatically operated projectile launchers.

In general, in the prior art, it is well known to utilize a pneumatically operated projectile launcher to propel a projectile at a target. Further, such a device is typically referred to as either a paintball gun or a marker. Accordingly, for the purpose of this application, the term marker will be utilized throughout this application to define a paintball gun or a pneumatically operated projectile launcher. While the present invention is discussed in connection with paintball guns, it has application in any type of projectile launching device.

There are a wide variety of markers available in the prior art having different configurations and manners of operation. Regardless of the configuration or mode of operation utilized by any particular marker, the general purpose of the marker is to utilize pneumatic force to launch a fragile spherical projectile containing colored marker dye, known as a paintball, at a target. When the paintball impacts upon the target, the paintball bursts releasing the marker dye onto the target thereby providing visual feedback that the target was, in fact, hit by the paintball. In this regard, before the paintball can be launched by the marker, a paintball must be first loaded into the firing chamber or breech of the marker in preparation for the release of a burst of air that ultimately launches the paintball.

FIGS. 1-3 generally illustrate the paintball loading operation of a prior art marker 10. The marker 10 can be seen to include a breech 14, a barrel 16 extending from one side of the breech 14, a reciprocating bolt 18 that is slidably received in the breech 14 in alignment with the barrel 16 and a feed port 20 to allow paintballs 12 to be loaded into the breech 14 of the marker 10. In operation, paintballs 12 are loaded in to the barrel 16 of the marker 10 by means of the bolt 18. The bolt 18 is arranged to move back and forth below the feed port 20 allowing paintballs 12 to pass, one at a time, through the feed port 20 and into the breech 14. The bolt 18 then moves forward, pushing the paintball 12 into the barrel 16 opening. Generally, these prior art devices rely on either manual operation of the bolt, mechanical valves or electronic solenoid valves that alternately switch compressed gas back and forth between the two sides of a double-acting pneumatic cylinder to move the bolt 18 for loading the paintballs 12. Such prior art pneumatic actuation of a bolt is well known in the art and need not be discussed in detail herein.

In order to illustrate the operation of the bolt 18, FIGS. 1-3 show a cross-sectional view of the breech 14 of a prior art marker 10 that includes a reciprocating bolt mechanism 18. In FIG. 1 the bolt 18 is show at rest in a position that would result immediately after firing a paintball 12 or prior to loading the initial paintball 12. Turning now to FIG. 2, the bolt 18 is shown after being moved in a rearward position. With the bolt 18 in this position, the feed port 20 is opened to allow a paintball 12 to drop into the breech 14. FIG. 3 then shows the bolt 18 after it has returned to the forward position having pushed the paintball 12 into the opening of the barrel 16, where it can be propelled by a pneumatic charge down the barrel 16 and launched out of the marker 10.

The difficulty is that markers that rely on mechanically or pneumatically driven reciprocating bolts suffer from mechanical limitations that inherently limit the maximum rate of fire that the marker can achieve. Specifically, the ultimate cycle speed of a pneumatically operated bolt is limited by the speed at which the solenoids in the air system can be sequentially opened and closed.

There is therefore a need for a bolt mechanism that overcomes the inherent limitations found in the prior art, thereby allowing the bolt mechanism to cycle faster, ultimately resulting in a marker that has a higher firing rate. There is a further need for a bolt mechanism that can be more precisely controlled than prior art bolts.

BRIEF SUMMARY OF THE INVENTION

In this regard, the present invention provides for a novel bolt mechanism that overcomes many of the problems with the prior art bolts identified above. In particular, the present invention provides a bolt mechanism that is actuated by an electro-magnetic arrangement, which provides for rapid movement of the bolt as well as a high degree of control over the bolt. The use of electro-magnetic force instead of electronic solenoids and a pneumatic piston to actuate the bolt in a marker is a departure from the known prior art and provides numerous advantages that result in a marker having higher reliability and improved performance.

As will be discussed in detail below, the base concept of the present invention is to utilize an arrangement of electro-magnetic coils that exert a force on ferrous materials or permanent magnets thereby causing the bolt to reciprocate back and forth. In one embodiment, a piece of ferrous material or a permanent magnet is installed into the body of the bolt and at least one electro-magnetic coil is installed in the wall of the breach adjacent the bolt. Application of an electrical charge to the electro-magnetic coil serves to attract or repel the magnet in the bolt, causing the bolt to be moved. In other embodiments, at least one coil is provided in the body of the bolt and at least one magnet or piece of ferrous material is installed in the wall of the breech, adjacent the bolt. In further embodiments, multiple electro-magnetic coils are utilized to increase the overall force exerted on the permanent magnet or ferrous material, thereby enhancing the speed at which the bolt can be moved. In another embodiment, the magnet or ferrous material is positioned adjacent the bolt in a chamber of its own with electro-magnetic coils placed within the walls of the chamber. The magnet or ferrous material is connected to the bolt by a linkage so that movement of the magnet or ferrous material results in movement of the bolt. In yet a further embodiment, the present invention provides for a rotary action bolt that includes at least one permanent magnet or piece of ferrous material mounted therein with an array of electromagnetic coils disposed around the wall of the breech surrounding the bolt. As each of the electromagnetic coils is activated by applying an electrical charge, the coils attract or repel the magnet or ferrous material, causing the rotary bolt to rotate.

In addition to the electro-magnetic system as described above, various sensors may also be incorporated into the marker and electrically coupled to the control system within the marker thereby providing unprecedented control over the bolt that was not previously possible with known pneumatic systems. As a result, the electronic operating system of the marker can more precisely control the loading and launching of the projectile.

As can be seen in view of the above, a new and novel electro-magnet bolt control system is provided. Further, a new and novel method of actuating a bolt within a marker without the use of pneumatics or electronically operated solenoid valves is shown. The use of electro-magnetic force as provided in the present invention allows for precise control of the travel of the bolt within a marker unlike the poor control capable of with a pneumatically piston-controlled bolt.

It is therefore an object of the present invention to provide an electro-magnetically operated bolt transport system for use in a pneumatic projectile launcher or marker. It is a further object of the present invention to provide an electro-magnetically operated bolt, wherein electro-magnetic coils are utilized to attract and/or repel a piece of ferrous material or permanent magnet thereby causing movement of the bolt. It is yet a further object of the present invention to provide an electro-magnetically operated bolt, wherein multiple electro-magnetic coils are utilized in conjunction to move a piece of ferrous material or permanent magnet thereby causing movement of the bolt. It is an even further object of the present invention to provide an electro-magnetic bolt control system that is equally applicable to both a slide bolt and a rotary bolt. It is still a further object of the present invention to provide sensors that are integrated with an electro-magnetically operated bolt system to facilitate a high degree of control over the movement of the bolt.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
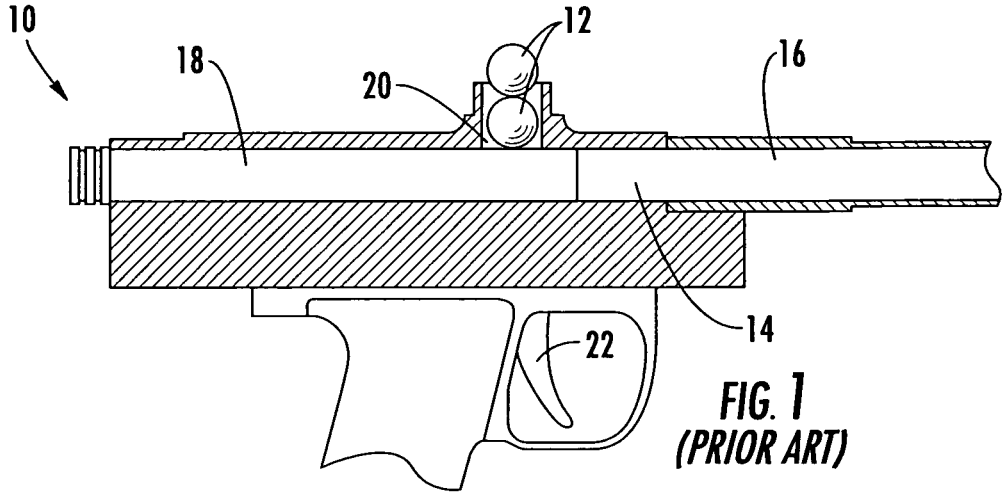
FIG. 1 (PRIOR ART)
FIG. 1 is a cross-sectional view of a prior art pneumatic projectile launcher with the bolt in a closed position.
Figure 2:
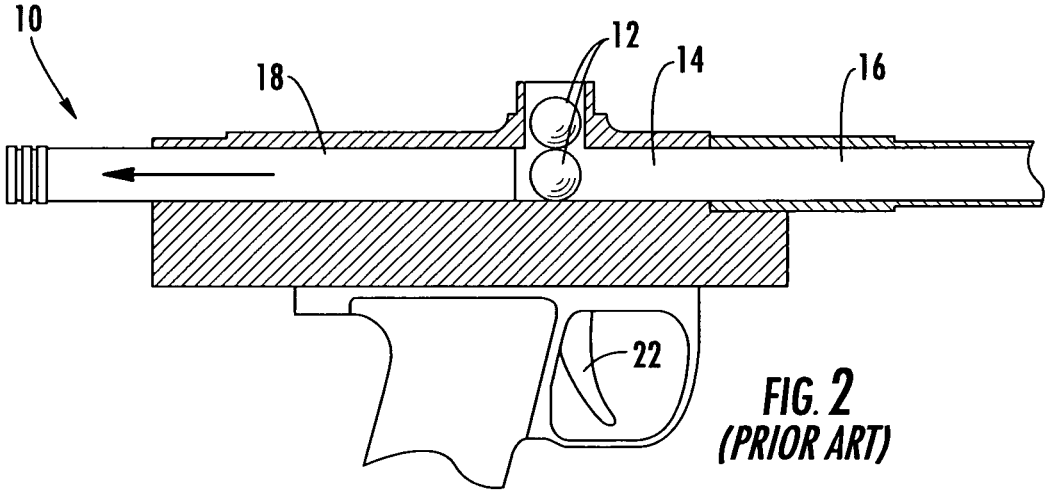
FIG. 2 (PRIOR ART)
FIG. 2 is a cross-sectional view of a prior art pneumatic projectile launcher with the bolt in an open position and a projectile dropping into the breech.
Figure 3:
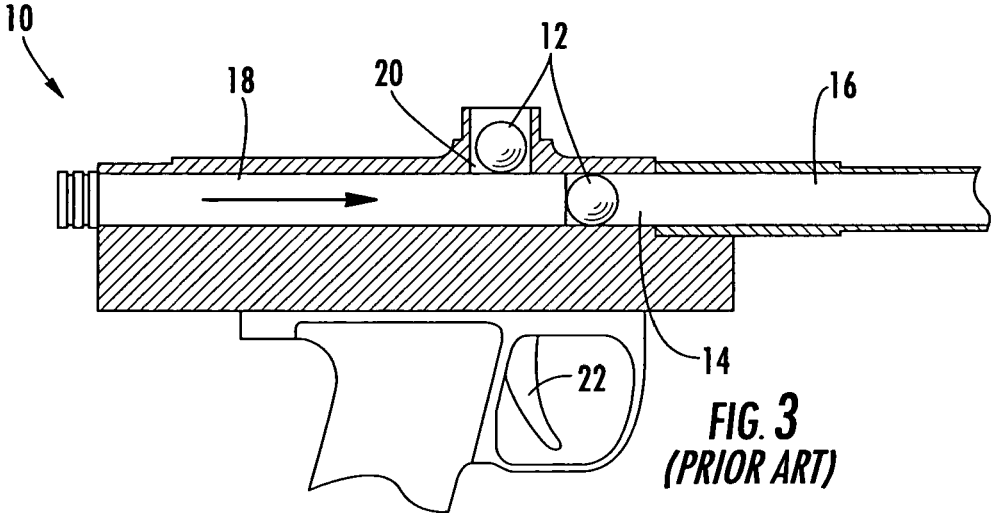
FIG. 3 (PRIOR ART)
FIG. 3 is a cross-sectional view of a prior art pneumatic projectile launcher with the bolt returning to a closed position, pushing the projectile into the chamber for launching.

Now referring to the drawings, as was stated above, FIGS. 1-3 generally illustrate a pneumatic projectile launcher 10 of the prior art and the manner in which the bolt 18 is operated to load a projectile 12 in preparation for launch. As was stated above, the present invention is applicable to any projectile launcher and the disclosure of the present invention is intended to be applicable with regard to its use in any type of projectile launching device. However, for the purpose of this application, the common term marker will be used when referring to the general class of projectile launchers.

Figure 4:
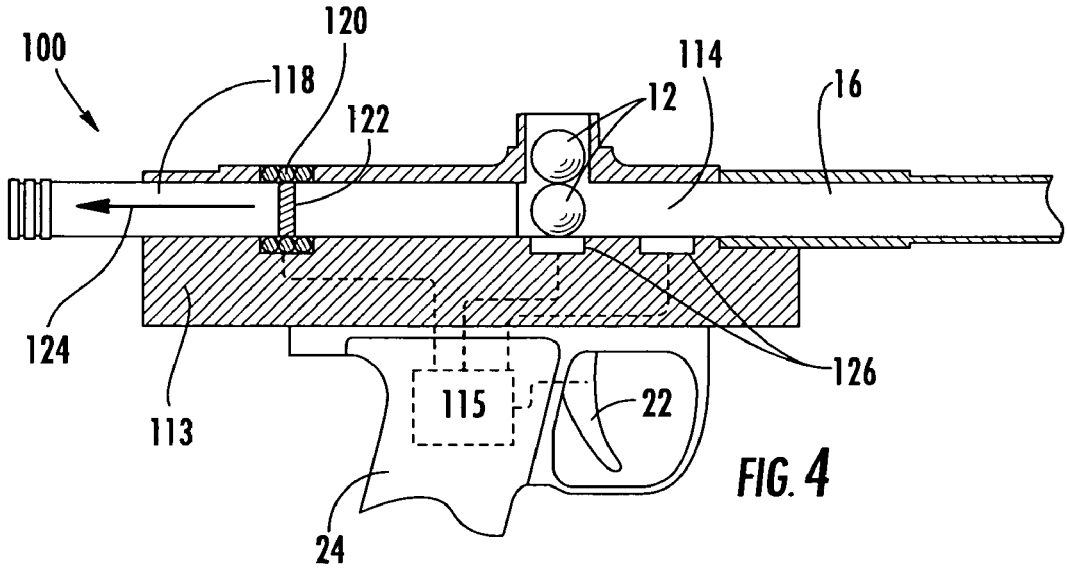
FIG. 4 is a cross-sectional view of a first embodiment of the pneumatic projectile launcher of the present invention with the bolt in an open position.
Figure 5:
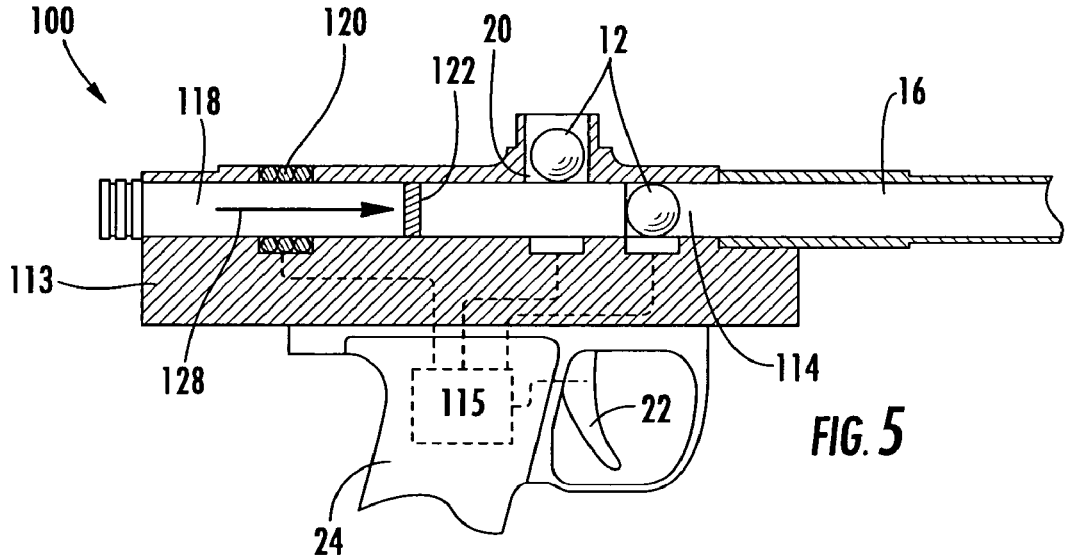
FIG. 5 is a cross-sectional view of the pneumatic projectile launcher of FIG. 4 with the bolt in a closed position.

Turning to FIGS. 4 and 5, a first preferred embodiment of the electro-magnetic bolt system of the present invention is shown and generally illustrated at 100. The bolt system 118 is shown installed in the breech 114 of a representational marker 100. The marker 100 generally includes a receiver body 113, a breech 114, a barrel 16, a feed port 20, an electro-magnetically actuated bolt 118, an actuator 22 and a control system 115 for controlling the operation of the marker 100. The control system 115 can be a control unit circuit board and operating system software, which are known structures for controlling the overall operation of the marker. Further, an LED or LCD display may be provided in conjunction with the control system 115 to monitor the operation of the marker 100. Optional control elements that interface with the control system 115 may include buttons or levers to modify settings within the marker 100 or an interface means so that the marker can be monitored by a remote device. Finally, the interface means may be through a wired connection or other wireless means that allow both monitoring and control of the marker 100 as well as allowing control programs to be downloaded into the marker 100 as desired.

The receiver body 113 is the central structural element of the marker 100 to which all of the other elements are connected. The breech 114 is a chamber located within the receiver body 113. The breech 114 serves as a guide within which the bolt assembly 118 operates to direct a projectile 12 from the feed port 20 to the barrel 16 as will be further described below. The barrel 16 is a hollow tubular member that extends from one end of the receiver body 113 and is in communication with the breech 114. The feed port 20 extends from the exterior of the receiver body 113 and into the breech 114, providing a path along which projectiles 12 are fed into the breech 114. Adjacent the exterior of the feed port 20 a means for containing a plurality of projectiles (not shown) is provided that serves to distribute the projectiles 12 into the feed port 20 opening. The bolt 118 of the present invention is positioned within the breech 114 and operates in a manner that controls and directs the flow of projectiles 12 from the feed port 20 into the barrel 16 for subsequent launching as will be more fully described in detail below. Finally, a handle 24 and an actuator 22, such as a trigger, are provided and attached to the receiver body 113 providing a means by which a user can hold and activate the marker 100.

In contrast to prior art markers, the present invention provides for the bolt 118 to be operated using electro-magnetic principles. In the simplest form, a first preferred embodiment of the electro-magnetic bolt 118 of the present invention is illustrated in FIGS. 4 and 5. In general, the principal upon which the present invention operates provides for the use of at least one magnetic coil 120 to attract or repel a permanent magnet 122 or other ferrous material. As can be seen in FIG.

4, a permanent magnet 122 is provided within the bolt 118 and an electro-magnetic coil 120 is positioned in the wall of the breech 114 surrounding the bolt 118. It should be noted that magnet 122 can be completely embedded within the bolt 118, embedded in the surface thereof or simply encircling it. When current is applied to the coil 120 in one direction, the coil 120 is energized creating a magnetic field that attracts the permanent magnet 122 within the bolt 118 causing the bolt 118 to move rearwardly as illustrated by the arrow 124. Once the bolt 118 clears the feed port 20 opening, a projectile 12 is then allowed to drop into the breech 114. As is best illustrated in FIG. 5, the control system 115 in the marker 100, upon sensing the presence of a projectile 12 in the breech 114, via sensors 126 within the marker 100, reverses the polarity of the current applied to the coil 120 thereby reversing the magnetic field generated by the coil 120. The reversed magnetic field generated by the coil 120 now serves to repel the magnet 120 within the bolt 118, causing the bolt 118 to slide forward as is indicated by the arrow 128, advancing the projectile 12 into the barrel 16 in preparation for launching the projectile 12.

Figure 6:
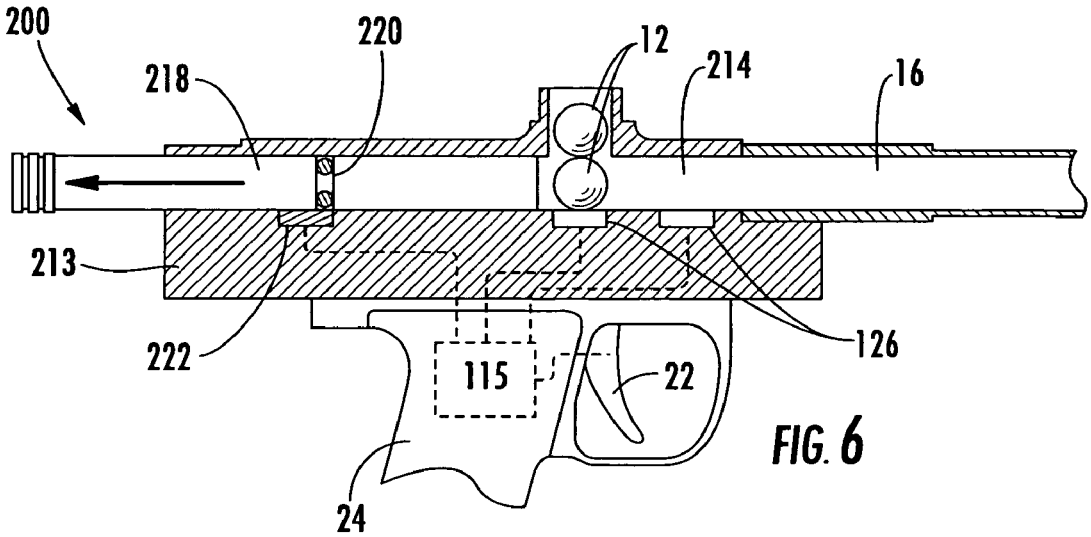
FIG. 6 is a cross-sectional view of a second alternate embodiment of the pneumatic projectile launcher of the present invention with the bolt in an open position.

A second embodiment marker 200 that utilizes the principals of the present invention is shown in FIG. 6. The bolt assembly 218 in this embodiment functions in the same manner as the one described above. In this embodiment however, the positioning of the electro-magnetic coil 220 and permanent magnet 222 have been reversed. The permanent magnet 222 is installed in the sidewall of the breech 214 and the coil 220 is positioned in the bolt 218. When electrical current is applied to the coil 220 in one direction, the coil 220 is energized causing a magnetic field that creates an attractive force between the permanent magnet 222 and the coil 220. Since the permanent magnet 222 is in a fixed location and the bolt 218 can slide, the attractive force causes the bolt 218 to slide to an open position allowing a projectile 12 to drop from the feed port 20 into the breech 214. As described above, when the polarity of the current applied to the coil 220 is reversed, the coil 220 repels the permanent magnet 222, thereby causing the bolt 218 to be moved to a closed position.

Figure 7:
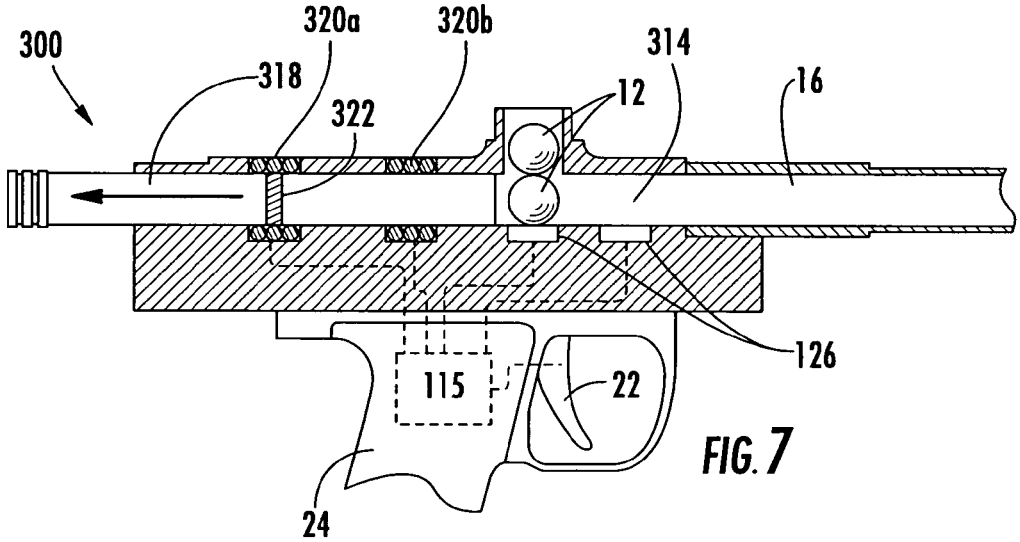
FIG. 7 is a cross-sectional view of a third alternate embodiment of the pneumatic projectile launcher of the present invention with the bolt in an open position.
Figure 8:
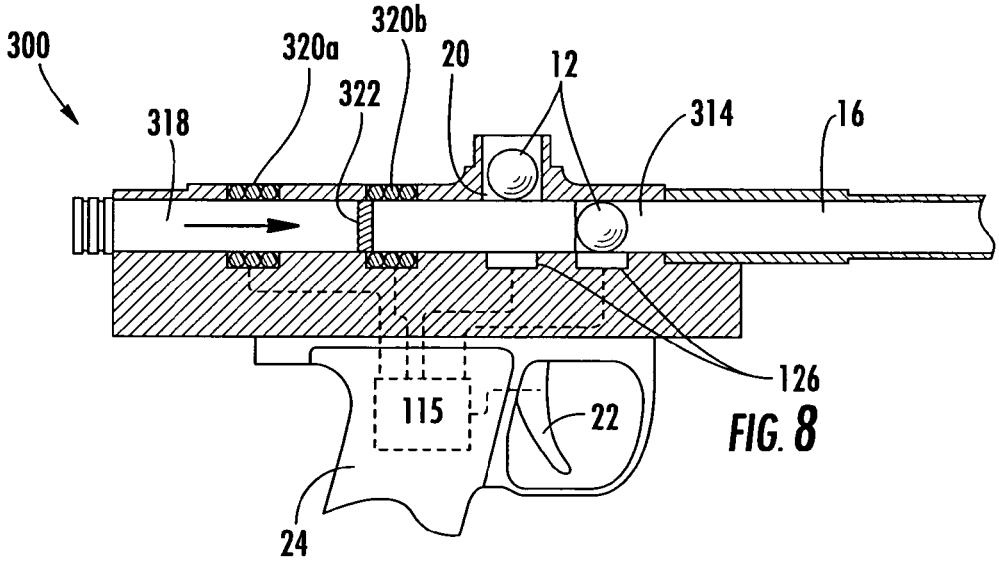
FIG. 8 is a cross-sectional view of the pneumatic projectile launcher of FIG. 7 with the bolt in a closed position.

It can be appreciated that in the configurations described above wherein a single coil is utilized, the coil must be used in conjunction with a permanent magnet so that the coil and magnet can interact to attract and/or repel one another. In other embodiments as will be described below, multiple coils may be utilized to attract and repel a permanent magnet. Further, should multiple coils be utilized, the magnet may be replaced with any ferrous material that is attracted by a magnetic field thereby allowing the coils to be operated in single direction to attract the ferrous material. For example, FIGS. 7 and 8 show a marker 300 in accordance with a third embodiment of the electro-magnetic bolt system 318 of the present invention where a front coil 320*b* and rear coil 320*a* have been installed in the wall of the breech 314. If a permanent magnet 322 is installed into the bolt 318, the front coil 320*b* can be energized to repel the magnet 322 and the rear coil 320*a* can be energized to attract the magnet 322 causing the bolt 318 to slide rearwardly to an open position allowing a projectile 12 to drop through the feed port 20 and into the breech 314. By reversing the polarity of the current on the front coil 320*b* and rear coil 320*a*, the front coil 320*b* now attracts the magnet 322 and the rear coil 320*a* repels the magnet 322 causing the bolt 318 to move into a closed position where the projectile 12 is slid into the barrel 16 for launching. When constructed in this manner, the electro-magnetic force acting on the magnet 322 is doubled allowing faster and more reliable shuttling of the bolt 318 between the open and closed positions.

One skilled in the art should appreciate that the magnet 322 shown in FIGS. 7 and 8 above could be replaced with a ferrous material 322. In this configuration, the front coil 320*b* and rear coil 320*a* would be energized sequentially. To open the bolt 318, the rear coil 320*a* is energized by the controller 115 causing the bolt 318 to slide rearwardly. To close the bolt 318, the rear coil 320*a* is de-energized and the front coil 320*b* is energized causing the bolt 318 to slide forward. It should also be appreciated that while two coils 320*a*, 320*b* are shown herein, any possible combination of an array of a plurality of coils in combination with more than one magnet or ferrous material may be utilized to cause movement of the bolt 318. In the broadest sense, the disclosure of the present invention is directed to moving the bolt 318 in a marker 300 utilizing electro-magnetic force. Therefore, while specific configurations are shown for the purpose of illustration the preferred embodiments of the invention, one skilled in the art can appreciated that there are literally dozens of other possible combinations wherein coils, magnets and ferrous materials are utilized to move or move a bolt mechanism in a marker, all of these combinations are intended to fall within the scope of the present disclosure.

By integrating sensors 126 into any of the markers illustrated herein, the controller 115 can monitor input from various points within the markers. For example, sensors 126 can be utilized to monitor the positioning of projectiles 12 within the markers or whether a projectile 12 is even present, or to monitor the position and speed at which the bolt is operating. This sensor feedback can be instantaneously processed by the controller 115 and used to quickly adjust the position of the bolt by simply energizing the coils and moving the bolt. This ability to precisely and quickly control the positioning of the bolt in response to sensor feedback was not previously available in the prior art.

Figure 9:
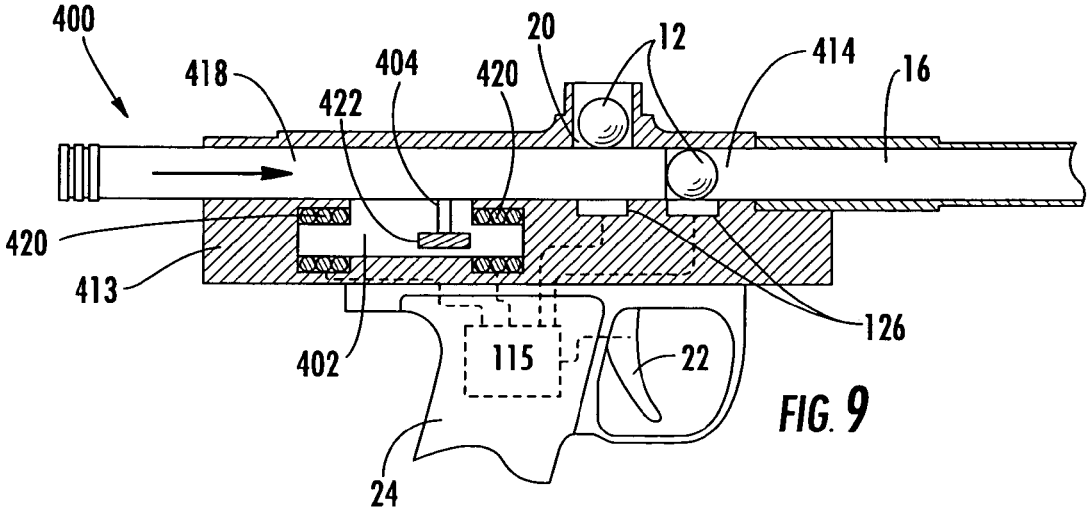
FIG. 9 is a cross-sectional view of a fourth alternate embodiment of the pneumatic projectile launcher of the present invention with the bolt in a closed position.

Turning now to FIG. 9, a marker 400 in accordance with a fourth embodiment of the present invention is shown wherein an actuator chamber 402 is provided in the receiver body 413 adjacent the breech 414. A linkage 404 extends from the bolt 418 into the actuator chamber 402 and terminates in either a permanent magnet 422 or a piece of ferrous material. Electromagnetic coils 420 are provided preferably at both ends of the actuator chamber 402, although one coil 420 may be utilized. In the same manner as described in detail above, the coils 420 are used to either attract or repel the magnet 422 or ferrous material thereby causing the linkage 404 and the bolt 418 to be moved as desired by the controller 115.

Figure 10:
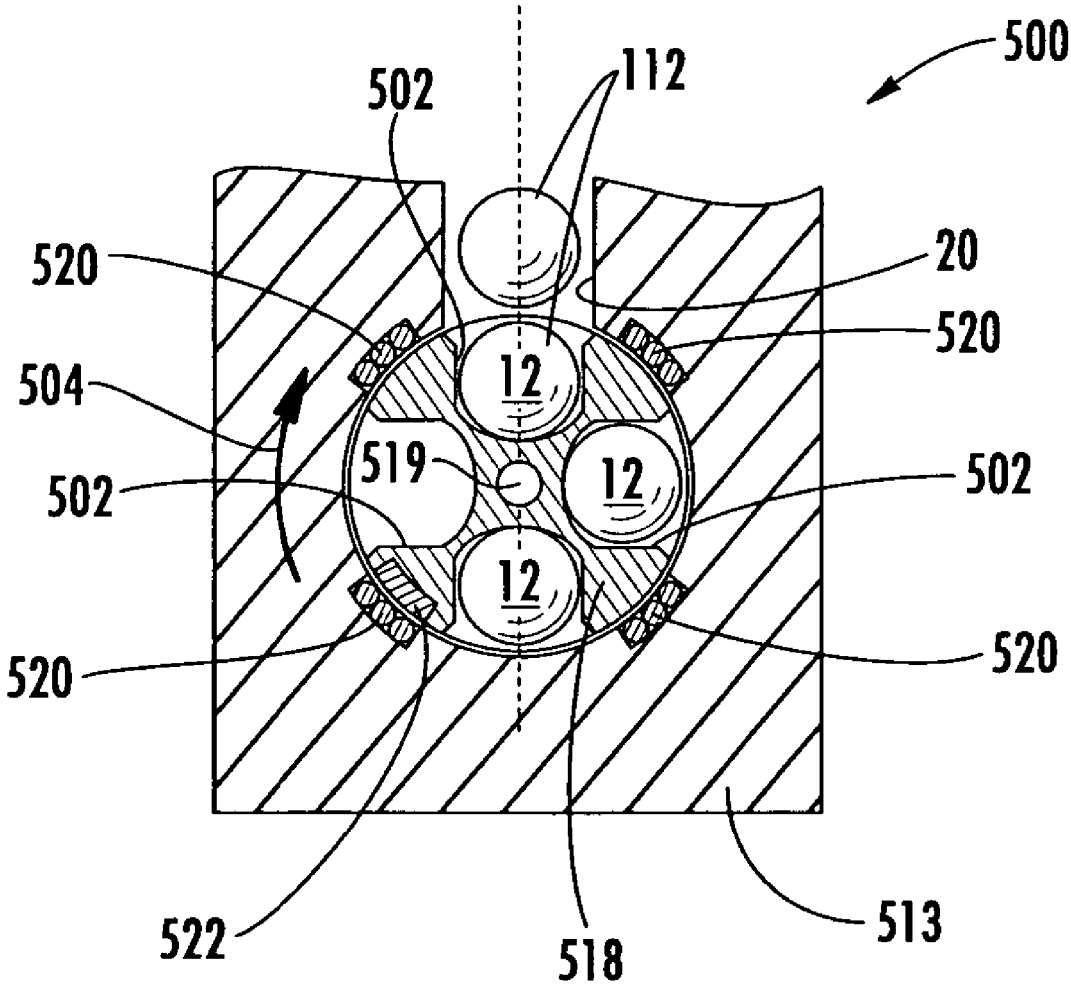
FIG. 10 is a cross-sectional view of a fifth alternate embodiment of the pneumatic projectile launcher of the present invention showing a rotary bolt.

FIG. 10 illustrates a marker 500 in accordance with a fifth embodiment where the principles of the present invention are employed in the context of a rotary bolt 518. The slidable bolt that was described above has now been replaced with a bolt 518 that is configured to rotate around an axis 519 that is aligned with the longitudinal axis of the marker 500. Again, electromagnetics are used to move a bolt for loading and launching of a projectile. The bolt 518 includes at least one seat 502 and preferably a plurality of seats 502 therein. As the bolt 518 rotates as illustrated by arrow 504, a projectile 12 drops through the feed port 20 into one of the seats 502. As the bolt 518 continues to rotate, the bolt 518 ultimately places the projectile 12 in alignment with the breach for launching of the projectile 12. In this embodiment, at least one permanent magnet 522 is provided in the rotary bolt 518 and a plurality of coils 520 is provided in the walls of the receiver body 513 around the bolt 518. The controller (not shown in this figure) sequentially energizes the coils 520 thereby attracting the magnet 522 and causing the bolt 518 to rotate as the magnet 522 is drawn to the next coil 520 in the energization sequence. Clearly, the position of the coils 520 and magnet 522 can be reversed and still be within the scope of the disclosure. Similarly, multiple magnets 522 may be utilized or ferrous material may be used in place of the permanent magnet 522 to operate the rotary bolt 518 in this embodiment in accordance with the principals disclosed above.

It can therefore be seen that the present invention provides an improved system for actuating a bolt within a marker using electro-magnetic forces in order to enhance the speed and reliability with which the bolt can be operated. Further by operating the bolt using electrically controlled coils in conjunction with sensors placed throughout the marker, a high degree of control over the operation of the bolt can be achieved. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An electro-magnetically operated rotational projectile loader, comprising:

a receiver body having a breech therein, said breech having a longitudinal axis;

a rotating projectile loader-belt received in said breech, said projectile loader-belt having at least one seat therein configured to rotate in a single direction around a rotational axis that is substantially aligned with the longitudinal axis of the breech thereby transporting a projectile from a projectile storage region to a position in said breech; and means for generating an electromagnetic force, said electro-magnetic force acting directly on said projectile loader, said electromagnetic force to selectively induce rotation of said projectile loader thereby moving the seat between the projectile storage region and the breech.

2. The electro-magnetically operated rotational projectile loader of claim 1, said means for generating an electro-magnetic force comprising:

at least one electro-magnetic coil;

at least one magnetically receptive object disposed proximal to said at least one electro-magnetic coil; and a controller for selectively energizing said electro-magnetic coil wherein said electro-magnetic coil generates a magnetic field that exerts a force on said at least one magnetically receptive object thereby inducing rotation of the projectile loader thereby moving the seat between the projectile storage region and the breech.

3. The electro-magnetically operated rotational projectile loader of claim 2, wherein said at least one electro-magnetic coil is disposed in said receiver body adjacent said breech and said at least one magnetically receptive object is disposed within said projectile loader.

4. The electro-magnetically operated rotational projectile loader of claim 2, wherein said at least one electro-magnetic coil is disposed in said projectile loader and said at least one magnetically receptive object is disposed within said receiver body adjacent said breech.

5. The electro-magnetically operated rotational projectile loader of claim 1, said means for generating an electromagnetic force comprises:

a first electro-magnetic coil;

a second electro-magnetic coil positioned in spaced relation to said first electro-magnetic coil;

at least one magnetically receptive object disposed proximal to the first and second electro-magnetic coils; and a controller for selectively energizing said first and second electro-magnetic coils wherein said electro-magnetic coils generate independent magnetic fields that each exert a force on said at least one magnetically receptive object inducing rotation of the projectile loader thereby moving the seat between the projectile storage region and the breech.

6. The electro-magnetically operated rotational projectile loader of claim 5, wherein said first electro-magnetic coil is disposed in said receiver body adjacent the projectile storage region, said second electro-magnetic coil is disposed in said receiver body adjacent said breech and said at least one magnetically receptive object is disposed within said projectile loader.

7. The electro-magnetically operated rotational projectile loader of claim 6, wherein said magnetically receptive object consists of a ferrous metal, said controller energizing said first electro-magnetic coil wherein said first electro-magnetic coil exerts an attractive force on said ferrous metal that rotates said projectile loader to position the seat adjacent the projectile region wherein a projectile is deposited into the seat and said controller energizing said second electro-magnetic coil wherein said second electro-magnetic coil exerts an attractive force on said ferrous metal that rotates said projectile loader to position the seat in alignment with the breach wherein said projectile is in a position to launch.

8. The electro-magnetically operated rotational projectile loader of claim 5, wherein said first electro-magnetic coil is disposed in one side of said projectile loader, said second electro-magnetic coil is disposed in a second opposing side of said projectile loader and said at least one magnetically receptive object is disposed within said receiver body.

9. The electro-magnetically operated rotational projectile loader of claim 8, wherein said magnetically receptive object consists of a ferrous metal, said controller energizing said first electro-magnetic coil wherein said first electro-magnetic coil exerts an attractive force on said ferrous metal that rotates said projectile loader to position the seat adjacent the projectile region wherein a projectile is deposited into the seat and said controller energizing said second electro-magnetic coil wherein said second electro-magnetic coil exerts an attractive force on said ferrous metal that rotates said projectile loader to position the seat in alignment with the breach wherein said projectile is in a position to launch.

10. A pneumatic projectile launcher comprising:

a receiver body;

a breech within said receiver body, said breech having a longitudinal axis and terminating in a firing chamber;

a rotating projectile loader located in said breech, said projectile loader having at least one seat therein configured to rotate in a single direction around a rotational axis that is substantially aligned with the longitudinal axis of the breech thereby transporting a projectile from a projectile storage region to a position in said breech;

a controller capable of controlling a loading operation, said controller generating an electro-magnetic force, said electro-magnetic force acting directly on said projectile loader, said electro-magnetic force to selectively induce rotation of said bolt thereby moving the seat between the projectile storage region and the breech wherein a projectile enters said breech to complete said loading operation.

11. The pneumatic projectile launcher of claim 10, said control assembly comprising:

at least one electro-magnetic coil;

at least one magnetically receptive object disposed proximal to the at least one electro-magnetic coil; and a controller for selectively energizing said electro-magnetic coil wherein said electro-magnetic coil generates a magnetic field that exerts a force on said at least one magnetically receptive object thereby inducing rotation of the projectile loader thereby moving the seat between the projectile storage region and the breech.

12. The pneumatic projectile launcher of claim 11, wherein said at least one electro-magnetic coil is disposed in said receiver body adjacent said breech and said at least one magnetically receptive object is disposed within said projectile loader.

13. The pneumatic projectile launcher of claim 11, wherein said at least one electro-magnetic coil is disposed in said projectile loader and said at least one magnetically receptive object is disposed within said receiver body adjacent said breech.

14. The pneumatic projectile launcher of claim 10, said control assembly comprising:

a first electro-magnetic coil;

a second electro-magnetic coil positioned in spaced relation to said first electro-magnetic coil;

at least one magnetically receptive object disposed proximal to said first and second electro-magnetic coils; and a controller for selectively energizing said first and second electro-magnetic coils wherein said electro-magnetic coils generate independent magnetic fields that each exert a force on said at least one magnetically receptive object inducing rotation of the projectile loader thereby moving the seat between the projectile storage region and the breech.

15. The pneumatic projectile launcher of claim 14, wherein said first electro-magnetic coil is disposed in said receiver body adjacent the projectile storage region, said second electro-magnetic coil is disposed in said receiver body adjacent said breech and said at least one magnetically receptive object is disposed within said projectile loader.

16. The pneumatic projectile launcher of claim 15, wherein said magnetically receptive object consists of a ferrous metal, said controller energizing said first electro-magnetic coil wherein said first electro-magnetic coil exerts an attractive force on said ferrous metal that rotates said projectile loader to position the seat adjacent the projectile region wherein a projectile is deposited into the seat and said controller energizing said second electro-magnetic coil wherein said second electro-magnetic coil exerts an attractive force on said ferrous metal that rotates said projectile loader to position the seat in alignment with the breach wherein said projectile is in a position to launch.

* * * * *